US011186396B2

(12) United States Patent
Serventi et al.

(10) Patent No.: US 11,186,396 B2
(45) Date of Patent: Nov. 30, 2021

(54) METHOD AND DEVICE FOR FILLING A CARTRIDGE FOR AN AEROSOL GENERATING DEVICE WITH A LIQUID

(71) Applicant: G.D SOCIETA' PER AZIONI, Bologna (IT)

(72) Inventors: Franco Serventi, Fornovo di Taro (IT); Catello Sorrentino, Colorno (IT); Giovanni Madera, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 166 days.

(21) Appl. No.: 16/483,764

(22) PCT Filed: Feb. 15, 2018

(86) PCT No.: PCT/IB2018/050942
§ 371 (c)(1),
(2) Date: Aug. 6, 2019

(87) PCT Pub. No.: WO2018/150356
PCT Pub. Date: Aug. 23, 2018

(65) Prior Publication Data

US 2020/0024018 A1 Jan. 23, 2020

(30) Foreign Application Priority Data

Feb. 15, 2017 (IT) ..... 102017000016823

(51) Int. Cl.
*B65B 31/00* (2006.01)
*B65B 3/04* (2006.01)
*B65B 43/56* (2006.01)

(52) U.S. Cl.
CPC ..... *B65B 31/003* (2013.01); *B65B 3/04* (2013.01); *B65B 43/56* (2013.01)

(58) Field of Classification Search
CPC ..... B65B 31/003; B65B 3/04; B65B 3/003; B65B 43/56; B65B 3/30; B65B 57/10; A24F 47/002
(Continued)

(56) References Cited

U.S. PATENT DOCUMENTS 3,324,904 A * 6/1967 Ctothers ..... B65B 39/004 141/86
3,343,616 A * 9/1967 Fellows ..... G01G 19/22 177/70
(Continued)

FOREIGN PATENT DOCUMENTS

DE 102011080664 A1 * 2/2013 ..... G01F 13/00

OTHER PUBLICATIONS

International Application No. PCT/IB2018/050942, International Search Report and Written Opinion, dated Jun. 28, 2018.

*Primary Examiner* — Timothy L Maust
*Assistant Examiner* — James R Hakomaki
(74) *Attorney, Agent, or Firm* — Marshall, Gerstein & Borun LLP

(57) ABSTRACT

Method and device for filling a cartridge for an aerosol generating device with a liquid, according to which is: supplied a cartridge comprising a container comprising a lateral wall and an absorbent element arranged in the container; arranged one dispensing end of at least one cannula between the lateral wall of the container and the absorbent element; and injected, a dosed quantity of liquid in the container through the cannula.

16 Claims, 8 Drawing Sheets

(58) Field of Classification Search
USPC ..... 141/144
See application file for complete search history.

(56) References Cited

U.S. PATENT DOCUMENTS 5,427,161 A * 6/1995 Luhmann ..... B67C 3/204 141/1
5,538,054 A * 7/1996 L uhmann ..... B67C 3/007 141/198
7,059,104 B2 * 6/2006 Taylor ..... B65B 3/34 53/130.1
7,814,939 B2 * 10/2010 Bernhard ..... B65C 9/40 141/1
8,479,784 B2 * 7/2013 Goldman ..... B67D 1/0041 141/144
8,807,176 B2 * 8/2014 Hilliard, Jr. ..... B01F 13/1055 141/9
8,944,117 B2 * 2/2015 Bertoni ..... G01F 23/261 141/2
9,429,460 B2 * 8/2016 Trump ..... G01F 23/263
10,214,306 B2 * 2/2019 Slurink ..... B65B 39/145
10,299,495 B2 * 5/2019 Moreau ..... B65B 39/005
2002/0063215 A1 * 5/2002 Yagita ..... G01N 21/9027 250/341.1
2006/0251783 A1 * 11/2006 D'Esposito ..... A23G 9/282 426/438
2010/0220187 A1 * 9/2010 Lichtblau ..... G01F 23/292 348/135
2011/0200718 A1 * 8/2011 Swertvaegher ..... A23G 9/283 426/130
2012/0241043 A1 * 9/2012 Perazzo ..... A61J 7/0053 141/2
2013/0255832 A1 * 10/2013 Uchida ..... B65B 3/04 141/83
2014/0238528 A1 * 8/2014 Spreizer ..... B65B 43/59 141/1
2015/0223522 A1 8/2015 Ampolini et al.
2015/0241341 A1 * 8/2015 Ikeda ..... B65B 57/10 250/338.1
2015/0289565 A1 10/2015 Cadieux et al.
2016/0354281 A1 * 12/2016 O'Neill ..... A61J 1/201
2016/0368642 A1 * 12/2016 Inoe ..... G01N 33/15
2018/0016040 A1 * 1/2018 Ewing ..... B65B 3/26
2019/0256231 A1 * 8/2019 Atkins ..... B65B 3/14

* cited by examiner

METHOD AND DEVICE FOR FILLING A CARTRIDGE FOR AN AEROSOL GENERATING DEVICE WITH A LIQUID

CROSS-REFERENCE TO RELATED APPLICATIONS

This is the U.S. national phase of International Application No. PCT/IB2018/050942, filed Feb. 15, 2018, which claims the benefit of Italian Patent Application No. 102017000016823, filed Feb. 15, 2015.

PRIORITY CLAIM

This application claims priority from Italian Patent Application No. 102017000016823 filed on Feb. 15, 2017, the disclosure of which is incorporated by reference.

TECHNICAL FIELD

The present invention relates to a method and a device for filling a cartridge for an aerosol generating device with a liquid.

In particular, the present invention refers to a method and a device for filling a cartridge with a liquid which comprises a container and an absorbent element arranged in the container.

PRIOR ART

Aerosol generating devices are known which comprise a battery, an atomizer which is supplied by the battery and a cartridge containing a liquid. During use, the atomizer heats the liquid contained in the cartridge and the smoker inhales the steam that is produced.

A cartridge of a type known for use with the aforesaid aerosol generating device comprises: a container; an absorbent element arranged in the container and in contact with the lateral wall of the container; a liquid (e.g., flavoured with tobacco or fruit) retained by the absorbent element; and a cap that closes the container.

In order to make the aforementioned cartridge the absorbent element, it is placed in the container and then, by the use of injecting means (for example, comprising a needle or a cannula), for a dosed quantity of liquid that is injected in the container without perforating the absorbent element.

However, said cartridge filling operation is rather slow since the absorption rate of the absorbent element is reduced. Moreover, in order to prevent the liquid from leaking out of the container, the speed with which the liquid is injected must necessarily be less than the absorption rate of the absorbent element.

In order to obviate the aforesaid problem, the document US 2015/0223522 A1 suggests injecting the dosed quantity of liquid in successive steps. For example, with reference to FIGS. 1A-1D, the dosed quantity of liquid is injected into the cartridge 100 in four separate steps: a first quarter of the dosed quantity of liquid is injected at a first angular position 101A of the absorbent body 101 of the cartridge 100 (FIG. 1A); a second quarter of the dosed quantity of liquid is injected at a second angular position 101B of the absorbent body 101 of the cartridge 100 (FIG. 1B); a third quarter of the dosed quantity of liquid is injected at a third angular position 101C of the absorbent body 101 of the cartridge 100 (FIG. 1C); and the last quarter of the dosed quantity of liquid is injected at a fourth angular position 101D of the absorbent body 101 of the cartridge 100 (FIG. 1D).

However, the aforementioned filling method allows for intermittently injecting the liquid and for moving the injecting means several times to fill each individual cartridge. As a result, the filling of the cartridge is an operation that takes quite a long time.

The patent application US2015289565A1 represents the closest state of the art and describes a method and a system for the automatic production of electronic vaporising devices.

DESCRIPTION OF THE INVENTION

The object of the invention is to provide a method and a device for filling a cartridge for an aerosol generating device with a liquid which overcomes the aforesaid drawback.

A further object of the present invention is to provide a method and a device which, besides allowing rapid filling of the cartridge, ensures that the absorbent element is not damaged.

The aforesaid objects have been obtained by means of a method and a device according to the appended claims.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

With reference to the attached FIGS. 2A-6D, a cartridge for an aerosol generating device has been generically denoted with the numerical reference 1.

The cartridge 1 comprises a container 10 and an absorbent element 11 arranged in the container 10. The container 10 can be made, for example, of stainless steel, plastic or glass whereas the absorbent element 11, which must absorb and retain a liquid, can for example be made of cotton.

According to the embodiment of the cartridge 1 illustrated in the figures, the container 10 comprises a bottom 10*a* and a lateral wall 10*b*. The lateral wall 10*b* rises from the bottom 10*a* and has a free edge 10*c*, opposed to the bottom 10*a*, which delimits an opening 10*d* of the container 10.

Figure 1B:
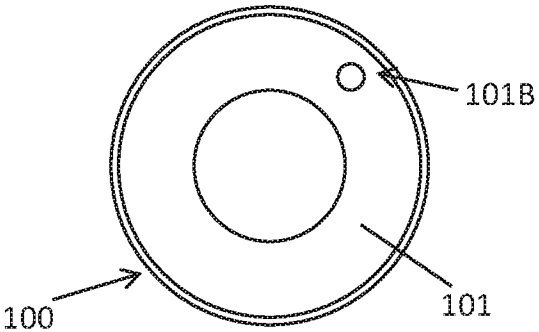
FIGS. 1A-1D are respectively top views of a cartridge during successive steps of the prior art method.
Figure 1D:
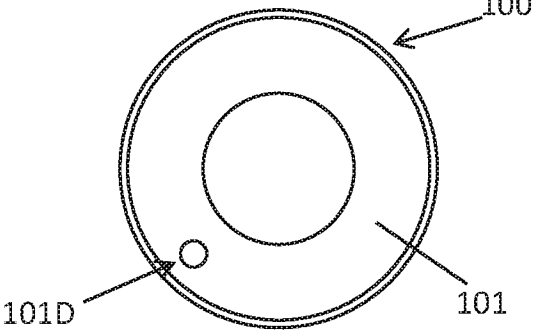
Figure 1A:
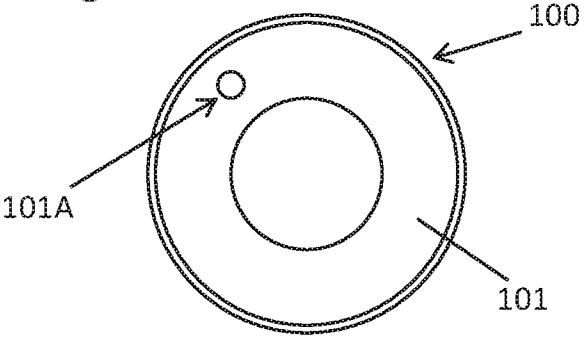
Figure 1C:
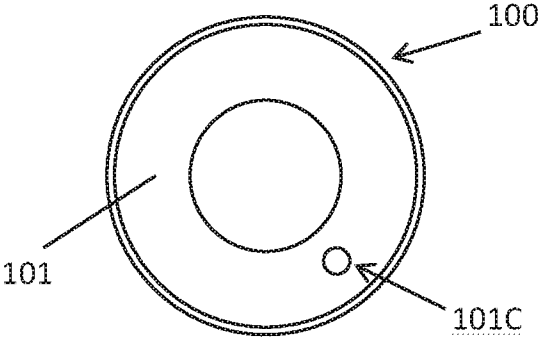
Fig. 1C PRIOR ART
Figure 2B:
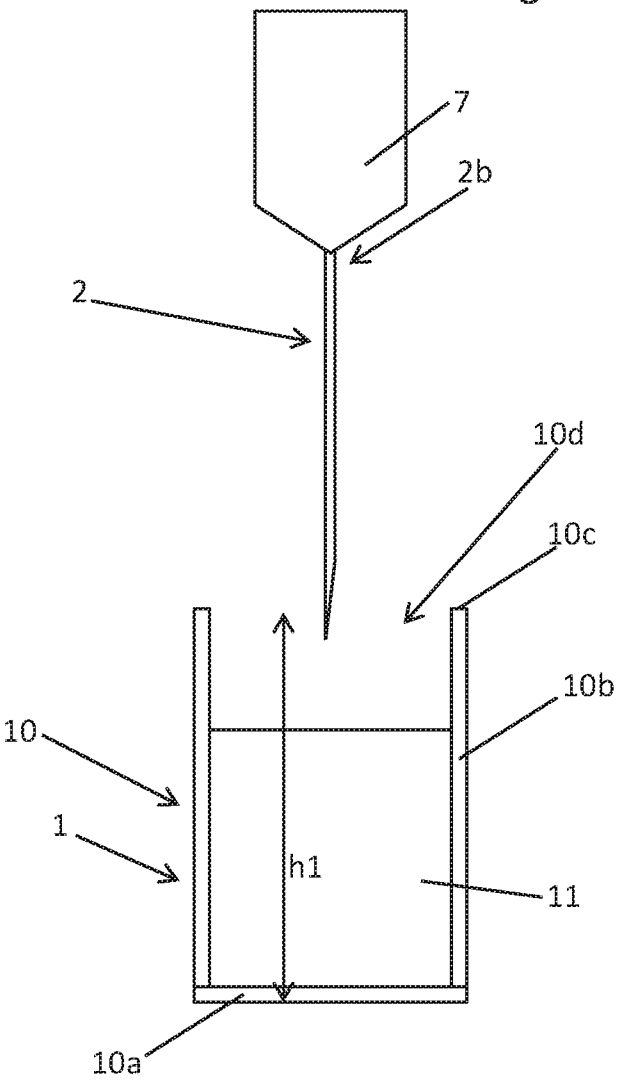
FIGS. 2A-2D are respectively cross-sectional views of a cartridge during successive steps of an embodiment of the method object of the present invention.
Figure 2A:
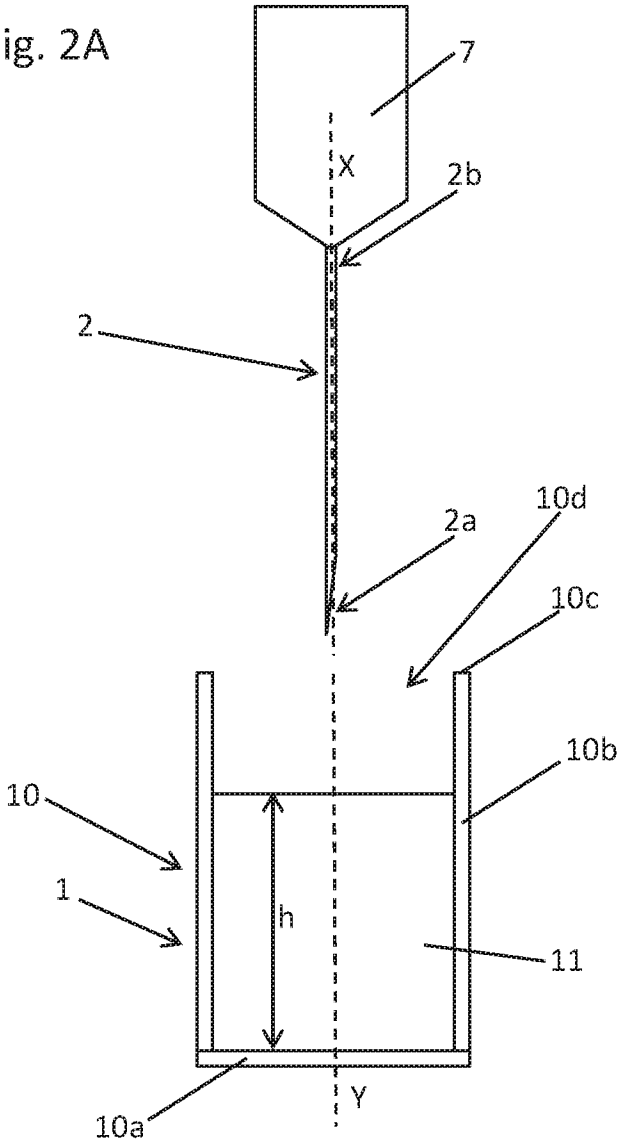
Figure 6B:
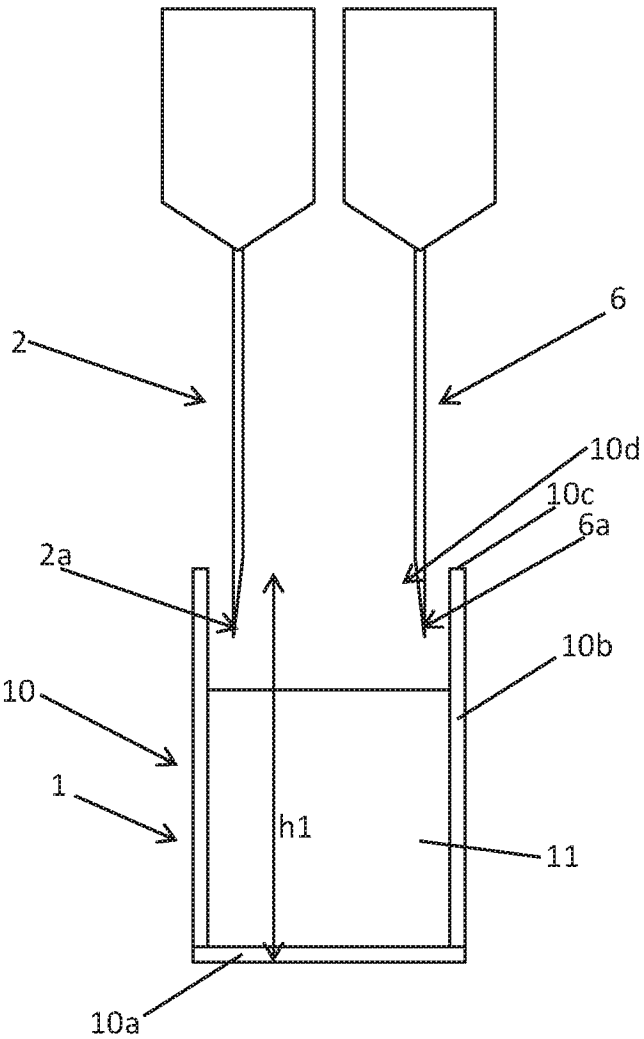
FIGS. 6A-6D are cross-sectional views of a cartridge, respectively, during successive steps of a further embodiment of the method object of the present invention.
Figure 6A:
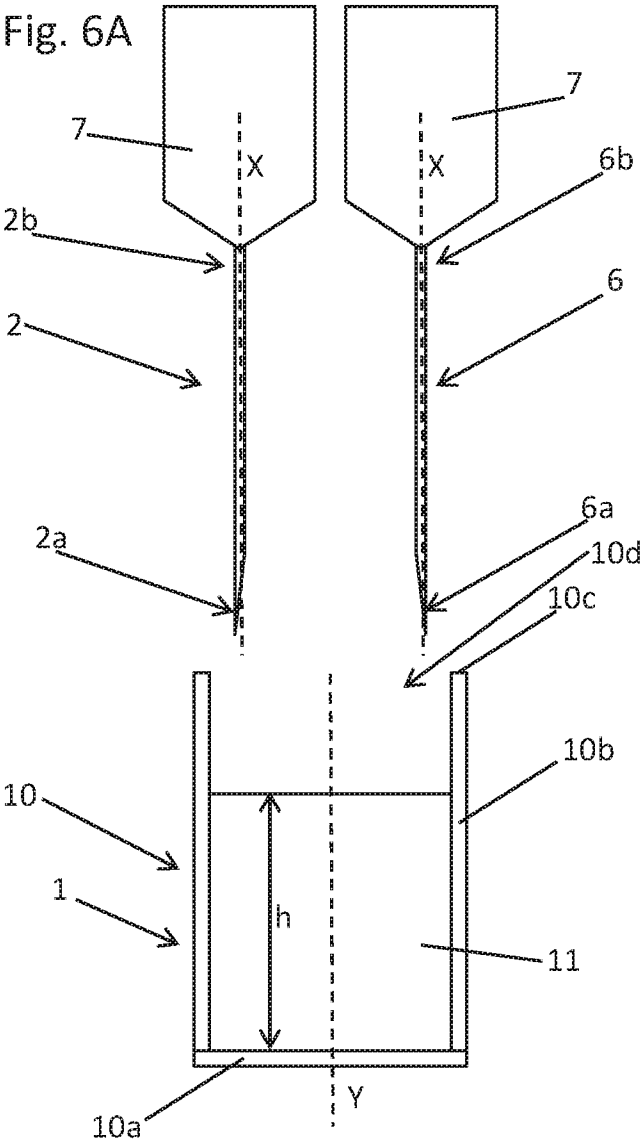

With particular reference to FIG. 2A or 6A, the container has a tubular shape with a circular and constant cross-section along the whole development of the container 10 and has a longitudinal development along a respective development axis Y.

Still with reference to the embodiment of the cartridge 1 illustrated in the figures, the absorbent element 11 is arranged in the container 10 so as to contact the bottom 10*a* and the lateral wall 10*b* of the container 10.

In particular, also the absorbent element 11 can have a tubular shape having a longitudinal development and have the same cross section having the same shape with respect to the cross section of the container 10. The absorbent element 11 comprises an upper face 11*a* which faces the opening 10*d* of the container 10.

The container 10 has a height h1 and the absorbent element 11 has a height h which is preferably smaller with respect to the height h1 of the container 10. Accordingly, the volume of the container 10 between the upper face 11*a* of the absorbent element 11 and the free edge 10*c* of the container 10 is empty.

It is understood that other embodiments of the cartridge 1 are allowed without departing from the scope of protection of the present invention. For example, the container 10 could have a square or hexagonal and/or non-constant cross section along the whole development of the container 10. Furthermore, the absorbent element 11 could be arranged in the container 10 so as to be in proximity of (without being put in contact with) the lateral wall 10*b* of the container 10 or it may not be in contact with the bottom 10*a* of the container 10. Furthermore, the absorbent element 10 could have a height h equal to the height h1 of the container 10.

With reference to FIGS. 2A-2D, a first embodiment of the method object of the present invention is described in the following.

The method comprises the steps of:

providing a cartridge 1 according to one of the aforementioned embodiments;

arranging a dispensing end 2*a* of a cannula 2 between the lateral wall 10*b* of the container 10 and the absorbent element 11;

injecting, a dosed quantity of liquid in the container 10 through the cannula 2.

Advantageously, due to the fact that the dispensing end 2*a* of the cannula 2 is arranged between the lateral wall 10*b* of the container 10 and the absorbent element 11, the proposed method allows to rapidly fill the cartridge 1 without damaging the absorbent element 11. In particular, the proposed method allows to inject the liquid with a higher speed than the absorption rate of the absorbent element 11 without risking the overflow of the liquid from the container 10.

The step of injecting the dosed quantity of liquid in the container 10 is carried out subsequently to the step of arranging the dispensing end 2*a* of the cannula 2 between the lateral wall 10*b* of the container 10 and the absorbent element 11.

Figure 2D:
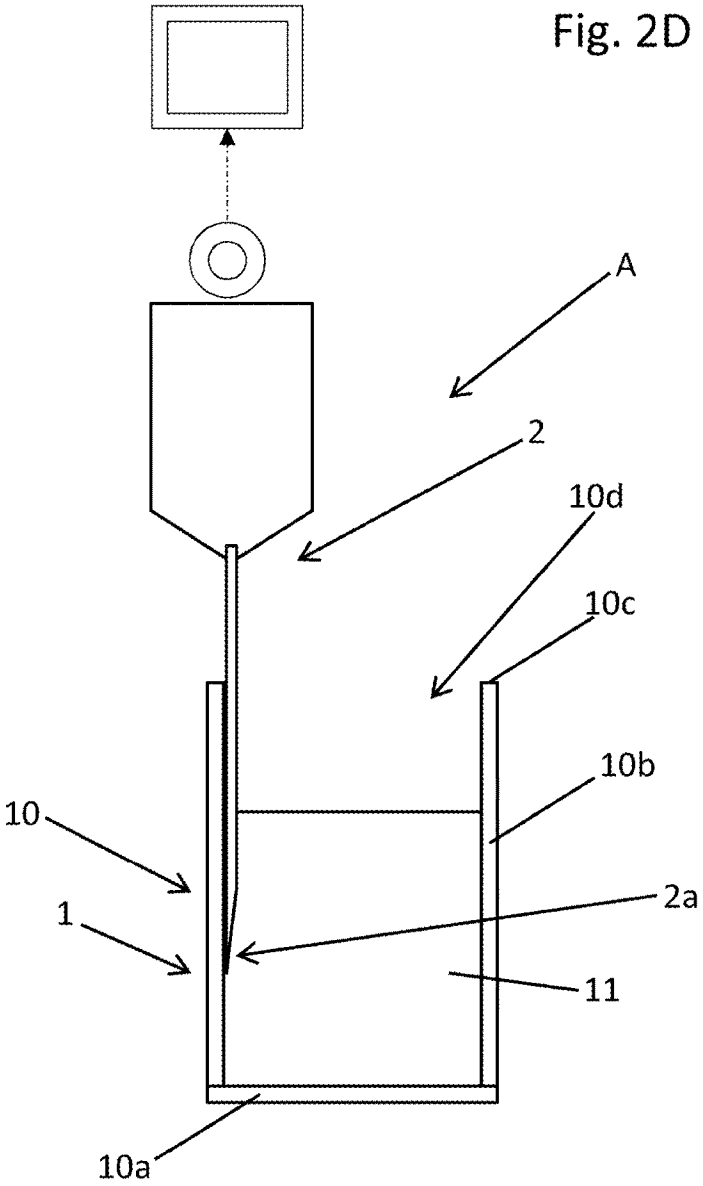
Figure 2C:
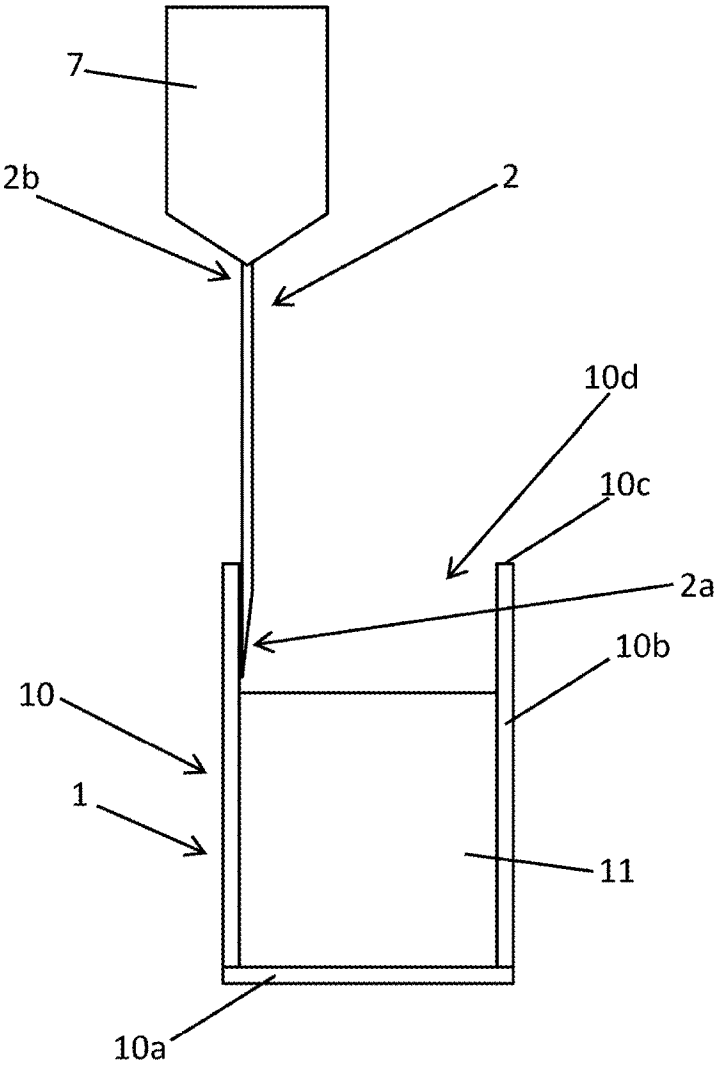

Preferably, the step of arranging the dispensing end 2*a* of the cannula 2 between the lateral wall 10*b* of the container 10 and the absorbent element 11 (FIG. 2D) comprises the steps of:

arranging the dispensing end 2*a* of the cannula 2 in contact with the lateral wall 10*b* of the container 10 (FIG. 2C);

reciprocally moving the cannula 2 and the cartridge 1 by sliding the dispensing end 2*a* of the cannula 2 along the lateral wall 10*b* of the container 10.

In this way, even if the absorbent element 11 is put in contact with or in proximity of the lateral wall 10*b* of the container 10, it is ensured that the absorbent element 11 is not damaged with the cannula 2.

First arrange the dispensing end 2*a* of the cannula 2 between the lateral wall 10*b* of the container 10 and the absorbent element 11, in particular before arranging the dispensing end 2*a* of the cannula 2 in contact with the lateral wall 10*b* of the container 10 the method may provide for arranging the dispensing end 2*a* of the cannula 2 facing the lateral wall 10*b* of the container 10 (FIG. 2B).

In other words, the dispensing end 2*a* of the cannula 2 is first placed in the container 10 between the upper face 11*a* of the absorbent element 11 and the free edge 10*c* of the container 10 and only subsequently the dispensing end 2*a* of the cannula 2, is arranged in contact with the lateral wall 10*b* of the container 10.

Advantageously, the risk of accidentally perforating the absorbent element 11 with the dispensing end 2*a* of the cannula 2 is reduced.

Preferably, the step of reciprocally moving the cannula 2 and the cartridge 1 by sliding the dispensing end 2*a* of the cannula 2 along the lateral wall 10*b* of the container 10 provides for sliding the dispensing end 2*a* of the cannula 2 towards the bottom 10*a* of the container 10.

The cannula 2 has a tubular shape, preferably cylindrical (such as a needle) and has a longitudinal development axis X.

Preferably, the step of reciprocally moving the cannula 2 and the cartridge 1 is performed by maintaining the development axis X of the cannula 2 and the development axis Y of the container 10 parallel to one another.

Advantageously, the cannula 2 is inserted between the absorbent element 11 and the side part 10*b* of the container 10 without damaging the absorbent element 11.

Preferably, the step of reciprocally moving the cannula 2 and the cartridge 1 provides for moving the cannula 2 while maintaining the cartridge 1 (with respect to the cannula 2) still.

Considering a cartridge 1 in which the absorbent element 11 is arranged in contact with the bottom 10*a* of the container 10, the step of arranging the dispensing end 2*a* of the cannula 2 between the lateral wall 10*b* of the container 10 and the absorbent element 11 provides for arranging the dispensing end 2*a* of the cannula 2 at a distance from the bottom 10*a* of the container 10 ranging between 30% and 70% of the predetermined height h of the absorbent element 11.

In this way the absorption of the liquid by the absorbent element 11 is optimized. Advantageously, the filling speed of the cartridge 1 increases.

Even more preferably, the step of arranging the dispensing end 2*a* of the cannula 2 between the lateral wall 10*b* of the container 10 and the absorbent element 11 provides for arranging the dispensing end 2*a* of the cannula 2 at midpoint of the predetermined height h of the absorbent element 11.

Referring to FIG. 2A, the cannula 2 and cartridge 1 are arranged in an inoperative position: the cannula 2 is arranged outside of the container 10 with the development axis X parallel to the development axis Y of the container 10 and with the dispensing end 2*a* facing the opening 10*d* of the container 10. In particular, the cannula 2 is arranged centered with respect to the bottom 10*a* of the container 10.

Starting from the inoperative position, the cannula 2 is moved towards the bottom 10*a* of the container 10 until the dispensing end 2*a* of the cannula 2 faces the lateral wall 10*b* of the container 10 (FIG. 2B). Still with reference to FIG. 2B, the dispensing end 2*a* of the cannula 2 is located between the upper face 11*a* of the absorbent element 11 and the free edge 10*c* of the container 10.

Subsequently, the cannula 2 is moved until the dispensing end 10 is brought into contact with the lateral wall 10*b* of the container 10 and above the upper face 11*a* of the absorbent element 11 (FIG. 2C). In particular, the dispensing end 2*a* of the cannula 2 is moved along an oblique trajectory with respect to the bottom 10*a* of the container 10: the dispensing end 2*a* of the cannula 2 is simultaneously translated both towards the lateral wall 10*b* and towards the bottom 10*a* of the container 10.

Finally, with reference to FIG. 2D, the cannula 2 is translated towards the bottom 10*a* of the container 10. In particular, the cannula 2 is maintained with the development axis X parallel to the development axis Y of the container 10 and is slid along the lateral wall 10*b* of the container 10 until the dispensing end 2*a* is arranged between the lateral wall 10*b* of the container 10 and the absorbent element 11.

With reference to FIGS. 6A-6D, a further embodiment of the method object of the present invention is described in the following. In said embodiment, the liquid is injected into the container 10 by means of a first cannula 2 and of a second cannula 6.

In particular, the method comprises the steps of:

arranging the dispensing end (2*a*) of the first cannula (2) and the dispensing end (6*a*) of the second cannula (6) between the lateral wall (10*b*) of the container (10) and the absorbent element (11);

injecting the dosed quantity of liquid in the container (10) through the first cannula (2) and the second cannula (6).

Advantageously, the time for filling the cartridge (1) is reduced.

Furthermore, the step of injecting the dosed quantity of liquid in the container (10) can provide for simultaneously injecting the liquid through the first cannula (2) and the second cannula (6). As a result, the time for filling the cartridge (1) is further reduced.

With reference to FIG. 6A, the first cannula 2, the second cannula 6 and the cartridge 1 are arranged in an inoperative position: the first cannula 2 and the second cannula 6 are arranged outside the container 10 with the development axis X parallel to the development axis Y of the container 10 and the respective dispensing ends 2*a*, 6*a* facing the opening 10*d* of the container 10.

Starting from the inoperative position, the first cannula 2 and the second cannula 6 are simultaneously moved towards the bottom 10*a* of the container 10 until the respective dispensing ends 2*a*, 6*a* are facing the lateral wall 10*b* of the container 10 (see FIG. 6B). Still with reference to FIG. 6B, the dispensing ends 2*a*, 6*a* are located between the upper face 11*a* of the absorbent element 11 and the free edge 10*c* of the container 10.

Figure 6D:
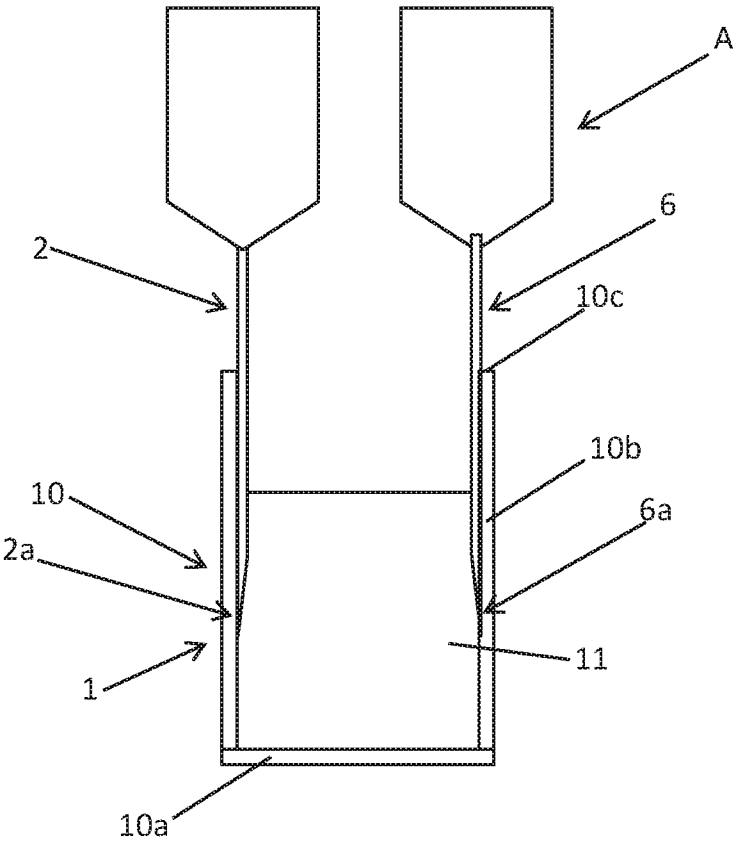
Figure 6C:
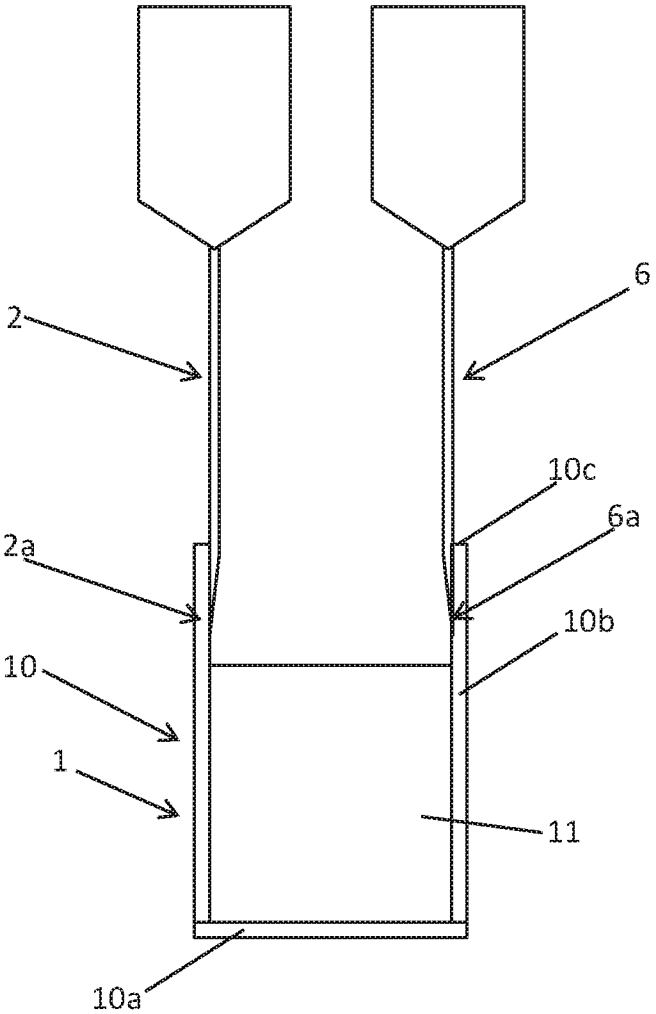

Subsequently, the first cannula 2 and the second cannula 6 are moved until the respective dispensing ends 2*a*, 6*a* are brought into contact with the lateral wall 10*b* of the container 10 and above the upper face 11*a* of the absorbent element 11 (FIG. 6C). In particular, the dispensing ends 2*a*, 6*a* are moved along oblique trajectories with respect to the bottom 10*a* of the container 10: the dispensing ends 2*a*, 6*a* are simultaneously both moved towards the lateral wall 10*b* (in opposite directions) and towards the bottom 10*a* of the container 10. Again, with reference to FIG. 6C, the dispensing end 2*a* of the first cannula 2 contacts the lateral wall 10*b* at a point opposite to the contact point of the dispensing end 6*a* of the second cannula 6.

Finally, with reference to FIG. 6D, the first cannula 2 and the second cannula 6 are moved towards the bottom 10*a* of the container 10. In particular, the first cannula 2 and the second cannula 6 are maintained with the respective development axis X parallel to the development axis Y of the container 10 and slid along the lateral wall 10*b* of the container 10 until the respective dispensing ends 2*a*, 6*a* are arranged between the lateral wall 10*b* of the container 10 and the absorbent element 11.

It is understood that, in accordance with both the first and second preferred embodiments of the method, in order to reach the operative position A it could be the cartridge 1 to be moved and the cannula 2 to be kept still.

Figure 3:
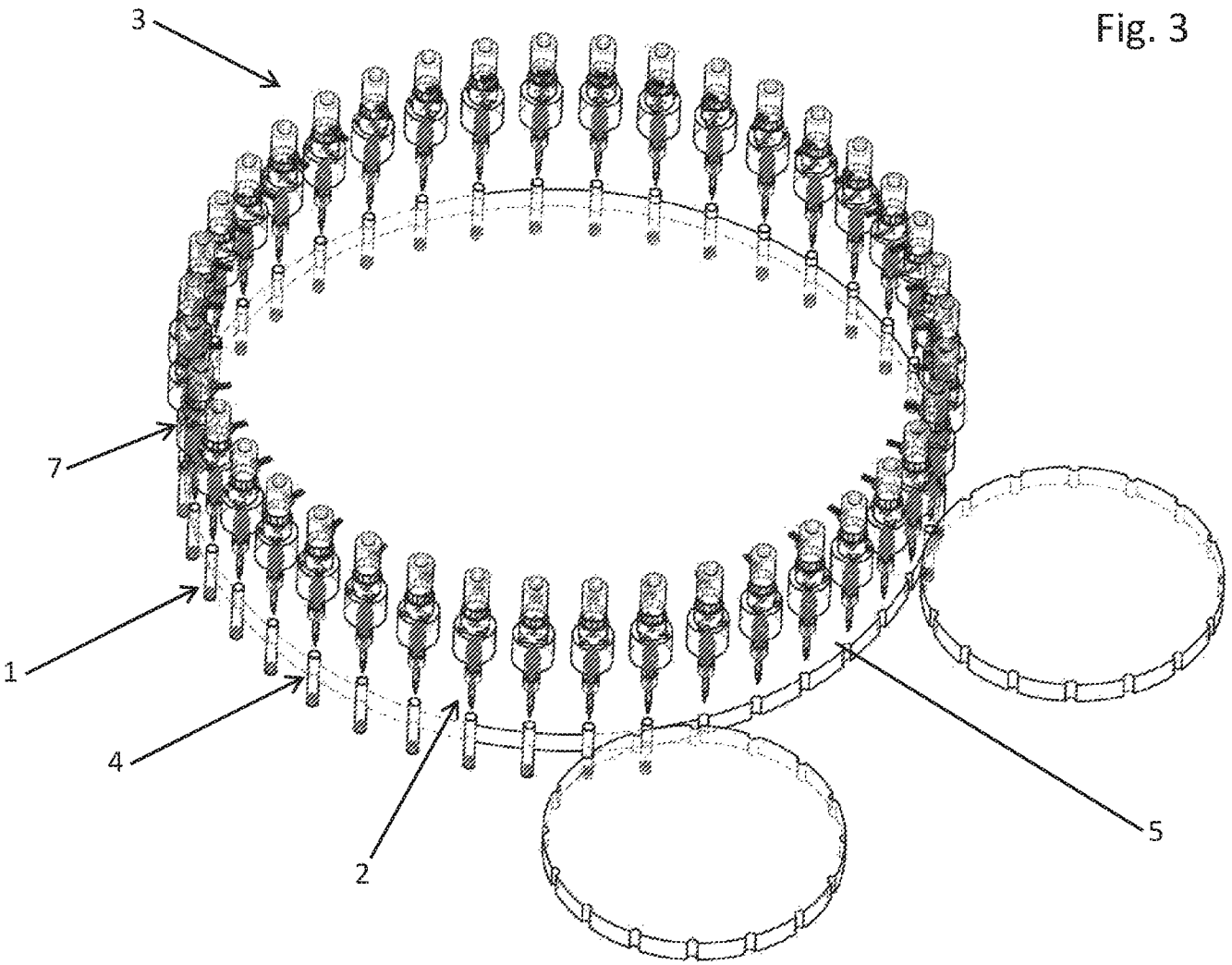
FIG. 3 is a perspective view of a part of the device object of the present invention.
Figure 4:
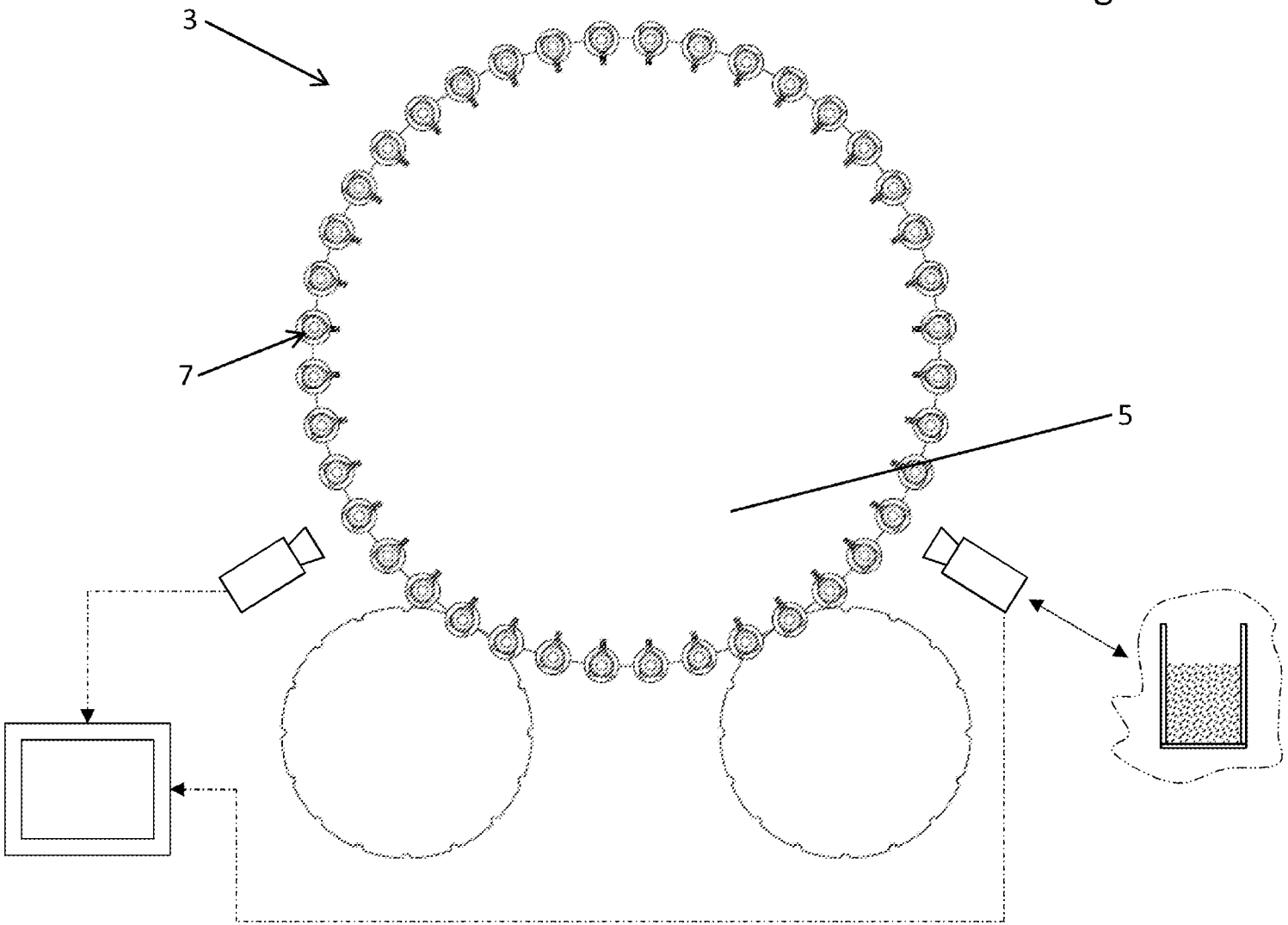
FIGS. 4 and 5 are a top view and a side view of the device of FIG. 3, respectively.
Figure 5:
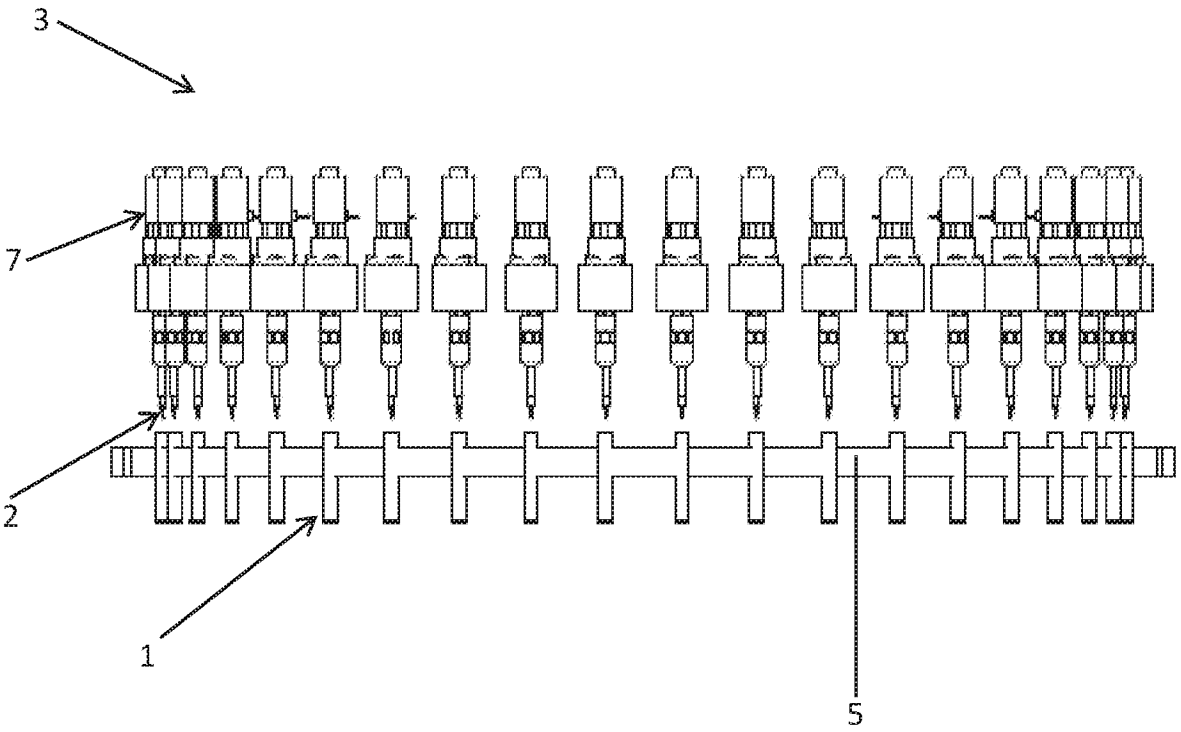

With reference to the attached FIGS. 3-5, a device for filling a cartridge 1 for an aerosol generating device with a liquid of the present invention has been generically denoted with the numerical reference 3.

The device 3 comprises:

a cannula 2;

at least one seat 4 shaped so as to receive a cartridge 1 according to one of the aforementioned described embodiments;

moving means for reciprocally moving the cartridge 1 and the cannula 2 from and towards an operative position A in which the dispensing end 2*a* of the cannula 2 is arranged between the lateral wall 10*b* of the container 10 and the absorbent element 11;

injecting means 7 for injecting a dosed quantity of a liquid in the cannula 2, when the cartridge 1 and the cannula 2 are in the operative position A.

Advantageously, the proposed device 3 allows the cartridge 1 to be filled with liquid in rather short times.

Preferably, the device 3 comprises a reservoir (not illustrated) for a liquid. In this case, the injecting means 7 put the reservoir and the cannula 2 in fluid communication to suck a dosed quantity of liquid from the reservoir and inject said dosed quantity into the cannula 2.

The cannula 2 has a tubular shape and comprises the dispensing end 2*a* from which the liquid flows out and an insertion end 2*b* from which the liquid is inserted.

The dispensing end 2*a* of the cannula (2) can be wedge-shaped. Said conformation of the dispensing end 2*a* facilitates the insertion of the dispensing end 2*a* of the cannula 2 between the absorbent element 11 and the lateral wall 10*b* of the container 10 without damaging the absorbent element 11. In fact, even in the case where the absorbent element 11 is put in contact with the lateral wall 10*b* of the container 10, this conformation of the dispensing end 2*a* leads to a slight deformation of the absorbent element 11 which is thus not perforated by the cannula 2.

Moreover, the device 3 can comprise: a wheel 5 rotating about a vertical axis, which wheel 5 comprises a plurality of said seats 4, each being shaped to receive a cartridge 1; a plurality of cannulas 2 which rotate about the vertical axis of the wheel 5. The rotation of the cannulas 2 is in phase with the rotation of the wheel 5. Each cannula 2 is arranged facing a seat 4 of the wheel 5 so that the cartridges 1 and the cannulas 2 are mutually movable from and towards the operating position A.

Advantageously, said structure of the device 3 allows the filling of several cartridges 1 at the same time.

In this case, the injecting means inject a dosed quantity of liquid into each cannula 2, when the cartridges 1 and the cannulas 2 are in the operative position A.

The device 3 may further comprise a control unit (not illustrated).

In said case, the device 3 can also comprise a sensor (not illustrated) to detect the presence of the cartridge 1 in the seat 4, which sensor is connected to the control unit to provide the detected data to the control unit. The control unit is in turn connected to the injecting means for controlling the injecting means on the basis of the data detected by the sensor.

Advantageously, the injection of liquid takes place only in the case in which a cartridge 1 is detected in a seat 4.

According to a further embodiment, the device 3 can comprise:

image acquisition means for capturing at least one image of the cannula 2 and of the cartridge 1 when moved towards the operative position A and a thermal image of the cartridge 1 after the insertion of the liquid;

a flow sensor for measuring the quantity of liquid that passes through the cannula 2.

The control unit is connected to the image acquisition means and to the flow sensor for evaluating whether the cartridge 1, after the injection of liquid into the cartridge 1, contains the correct quantity of liquid.

By means of the above evaluations, in particular, it is not strictly necessary to weigh the cartridge 1 before and after the filling: it is known that the weighing of the cartridge 1 can be approximate because of the vibrations present in the device 3.

In detail, the image acquisition means allow the capturing of at least one image illustrating the correct positioning of the cannula 2 in the container 10.

Moreover, the image acquisition means allows the capturing of at least one thermal image of the cartridge 1 after the insertion of the liquid: said thermal image is compared with a reference thermal image (a sample image or a thermal image acquired before inserting the liquid).

Preferably, the image acquisition means comprise: a camera which captures at least one image of the cannula (2) and of the cartridge (1) to evaluate the correct mutual positioning of the cannula (2) and of the cartridge (1) when moved towards the operating position (A); a thermographic camera that captures the thermal image of the cartridge (1) after the insertion of the liquid.

The means for moving the device 3 can comprise a mechanical cam. For example, said mechanical cam can be connected to the cannula 2 to move the cannula 2 with respect to the cartridge 1. Advantageously, the use of the mechanical cam allows high precision in handling.

The injecting means 7 can comprise a membrane pump.

In particular, in the case wherein the device 3 comprises a plurality of seats 4 and a plurality of cannulas 2, the injecting means 7 can comprise a membrane pump connected to each cannula 2.

The invention claimed is:

1. A method for filling a cartridge (1) for an aerosol generating device with a liquid, comprising the steps of:

providing a cartridge (1) comprising a container (10) having a bottom (10*a*) and a lateral wall (10*b*) which rises from the bottom (10*a*) and an absorbent element (11) arranged in the container (10);

moving the cartridge (1) and at least one cannula (2) from and towards an operative position (A) in which a dispensing end (2*a*) of the cannula (2) is arranged between the lateral wall (10*b*) of the container (10) and the absorbent element (11);

injecting a dosed quantity of liquid in the container (10) through the cannula (2);

capturing, by means of image acquisition means, at least one image of the cannula (2) and of the cartridge (1), when they are moved towards the operative position (A) and a thermal image of the cartridge (1) after the insertion of the liquid;

measuring, by means of a flow sensor, the quantity of liquid passing through the cannula (2); and evaluating if the cartridge contains the correct dosed quantity of liquid, after the injection of the liquid into the cartridge (1), using a control unit connected to the image acquisition means and to the flow sensor.

2. The method according to claim 1, wherein the absorbent element (11) is put in contact with or in proximity of the lateral wall (10*b*) of the container (10) and wherein the step of arranging the dispensing end (2*a*) of the cannula (2) between the lateral wall (10*b*) of the container (10) and the absorbent element (11) comprises: arranging the dispensing end (2*a*) of the cannula (2) in contact with the lateral wall (10*b*) of the container (10); reciprocally moving the cannula (2) and the cartridge (1) by sliding the dispensing end (2*a*) of the cannula (2) along the lateral wall (10*b*) of the container (10).

3. The method according to claim 2, comprising the step of arranging the dispensing end (2*a*) of the cannula (2) facing the lateral wall (10*b*) of the container (10), before arranging the dispensing end (2*a*) of the cannula (2) in contact with the lateral wall (10*b*) of the container (10).

4. The method according to claim 2, wherein the step of reciprocally moving the cannula (2) and the cartridge (1) by sliding the dispensing end (2*a*) of the cannula (2) along the lateral wall (10*b*) of the container (10) comprises the sliding of the dispensing end (2*a*) of the cannula (2) towards the bottom (10*a*) of the container (10).

5. The method according to claim 2, wherein the cannula (2) has a longitudinal development axis (X) and wherein the container (10) has a longitudinal development along a respective development axis (Y); the step of reciprocally moving the cannula (2) and the cartridge (1) is carried out by maintaining the development axis (X) of the cannula (2) and the development axis (Y) of the container (10) parallel to one another.

6. The method according to claim 2, wherein the step of reciprocally moving the cannula (2) and the cartridge (1) comprises the moving of the cannula (2) and maintaining the cartridge (1) stationary.

7. The method according to claim 1, wherein:

the absorbent element (11) has a predetermined height (h) and is arranged in contact with the bottom (10*a*) of the container; and the step of arranging the dispensing end (2*a*) of the cannula (2) between the lateral wall (10*b*) of the container (10) and the absorbent element (11) provides for arranging the dispensing end (2*a*) of the cannula (2) at a distance from the bottom (10*a*) of the container ranging between 30% and 70% of the height (h) of the absorbent element (11).

8. The method according to claim 1, comprising the steps of:

arranging the dispensing end (2*a*) of a first cannula (2) and the dispensing end (6*a*) of a second cannula (6) between the lateral wall (10*b*) of the container (10) and the absorbent element (11);

injecting the dosed quantity of liquid in the container (10) through the first cannula (2) and the second cannula (6).

9. The method according to claim 8, wherein the step of injecting the dosed quantity of liquid in the container (10) comprises the simultaneously injection of the liquid through the first cannula (2) and the second cannula (6).

10. A device (3) for filling a cartridge (1) for an aerosol generating device with a liquid, which cartridge (1) comprises a container (10) and an absorbent element (11) arranged in the container (10) and the container comprises a bottom (10*a*) and a lateral wall (10*b*) which rises from the bottom (10*a*); the device (3) comprising:

at least one cannula (2);

at least one seat (4) shaped to receive a cartridge (1);

moving means for reciprocally moving the cartridge (1) and the cannula (2) from and towards an operative position (A) in which a dispensing end (2*a*) of the cannula (2) is arranged between the lateral wall (10*b*) of the container (10) and the absorbent element (11);

injecting means (7) for injecting a dosed quantity of a liquid in the cannula (2), when the cartridge (1) and the cannula (2) are in the operative position (A);

image acquisition means for capturing at least one image of the cannula (2) and of the cartridge (1), when they are moved towards the operative position (A) and a thermal image of the cartridge (1) after the insertion of the liquid;

a flow sensor for measuring the quantity of liquid passing through the cannula (2); and a control unit connected to the image acquisition means and to the flow sensor for evaluating if the cartridge contains the correct dosed quantity of liquid, after the injection of the liquid into the cartridge (1).

11. The method according to claim 1, wherein the image acquisition means comprise:

a camera that acquires at least one image of the cannula (2) and of the cartridge (1) for evaluating the correct mutual positioning of the cannula (2) and of the cartridge (1) when they are moved towards the operative position (A); and a thermographic camera that acquires the thermal image of the cartridge (1) after the insertion of the liquid.

12. The method according to claim 1, wherein said thermal image is compared with a reference thermal image.

13. The device (3) according to claim 10, wherein the dispensing end (2*a*) of the cannula (2) is wedge-shaped.

14. The device (3) according to claim 10, comprising: a wheel (5) rotating about a vertical axis, which wheel (5) comprises a plurality of said seats (4), each shaped to receive a cartridge (1); a plurality of cannulas (2) which rotate about the vertical axis of the wheel (5), the rotation of the cannulas (2) being in phase with the rotation of the wheel (5); each cannula (2) facing a seat (4) of the wheel (5) so that the cartridges (1) and the cannulas (2) are mutually movable from and towards the operative position (A).

15. The device (3) according to claim 10, wherein the image acquisition means comprise:

a camera that acquires at least one image of the cannula (2) and of the cartridge (1) for evaluating the correct mutual positioning of the cannula (2) and of the cartridge (1) when they are moved towards the operative position (A); and a thermographic camera that acquires the thermal image of the cartridge (1) after the insertion of the liquid.

16. The device (3) according to claim 10, wherein the the control unit compares said thermal image with a reference thermal image.

* * * * *